US005651164A

United States Patent [19]

DeMarco

[11] Patent Number: 5,651,164

[45] Date of Patent: Jul. 29, 1997

[54] RELEASABLE DOUBLE-HINGE KIT FOR A VEHICLE HOOD

[76] Inventor: Stephen R. DeMarco, Rte. 3, Box 376-M, Clinton, N.C. 28328

[21] Appl. No.: 488,684

[22] Filed: Jun. 8, 1995

[51] Int. Cl.[6] ..... E05D 15/50; E05D 7/02

[52] U.S. Cl. ..... 16/230; 16/232; 16/233; 49/193; 49/382

[58] Field of Search ..... 16/233, 232, 231, 16/230; 49/193, 382, 192; 292/219, DIG. 7, 198

[56] References Cited

U.S. PATENT DOCUMENTS

| | | | |
|---|---|---|---|
| 707,910 | 8/1902 | Fischer et al. | 16/230 |
| 2,261,146 | 11/1941 | Dow | 16/230 |
| 2,620,889 | 12/1952 | McCormick | 16/232 |
| 2,660,752 | 12/1953 | Carcereny | 16/230 |
| 2,822,630 | 2/1958 | Guyer | 49/193 |
| 3,654,663 | 4/1972 | Algotsson | 16/230 |
| 5,148,629 | 9/1992 | Minami | 49/193 |
| 5,274,881 | 1/1994 | DeRosa | 16/231 |
| 5,367,828 | 11/1994 | Hashemnia | 49/193 |

*Primary Examiner*—Daniel W. Howell
*Assistant Examiner*—Christopher Kirkman
*Attorney, Agent, or Firm*—Rhodes, Coats, & Bennett, LLP

[57] ABSTRACT

A kit is provided for mounting the opposite sides of a vehicle hood about a releasable hinge pin assembly. This effectively forms a hinge joint along opposites sides of the hood. Each hinge pin assembly includes a retractable hinge pin or pins. This permits one side of the hood to be raised and lowed while the other side is hinged, and vice versa.

12 Claims, 5 Drawing Sheets

RELEASABLE DOUBLE-HINGE KIT FOR A VEHICLE HOOD

FIELD OF THE INVENTION

The present invention relates to hobby and custom car kits and more particularly to a hinge kit for hinging both sides of a hood structure to the vehicle hood structure surrounding the hood opening.

BACKGROUND OF THE INVENTION

Hobby and custom cars are very popular today. They are typically built from kits. Hoods for these hobby and custom vehicles can be of many designs. For example, many vintage cars employed a hood design that included a center hinge structure that allowed the hood to be opened from both sides about a common center hinge. Recently, hobby and custom cars have moved to a smooth and clean hood design and in order to achieve such a design have departed from using a single center common hinge structure. These recent hood designs have employed a side hinge assembly that allows the hood to open and close about a single side hinge. However, these side hinge designs have a number of drawbacks. The main drawback is that it is difficult to gain access to the engine compartment adjacent the hinged side of the hood.

Therefore, there has been and continues to be a need for a hood connecting structure that is simple in design, easy to install and which will permit easy access to all areas of the engine compartment.

SUMMARY AND OBJECT OF THE INVENTION

The present invention entails a double-hinge kit for a vehicle hood that allows the hood to both hinge and open from opposite sides. In particular, the double-hinge kit of the present invention entails a pair of side hinge assemblies with each hinge assembly connected about one side of the hood and along one side of the open engine compartment of the vehicle. Each side hinge assembly includes a retractable hinge pin or pins that permit the side hinge assembly to be released or disconnected such that either side of the hood can be raised and lowered while the other side is in fact connected by a like hinge assembly.

It is therefore an object of the present invention to provide a double-hinge kit for connecting opposite sides of the hood about an engine compartment such that the hood can be swung open from either side.

Another object of the present invention is to provide a double-hinge kit for connecting opposite sides of a hood about the engine compartment of a vehicle that is simple, easy to install and which permits either side of the hood to be raised and lowered while the opposite side is hinged about the hinge kit.

DESCRIPTION OF THE INVENTION

Figure 1:
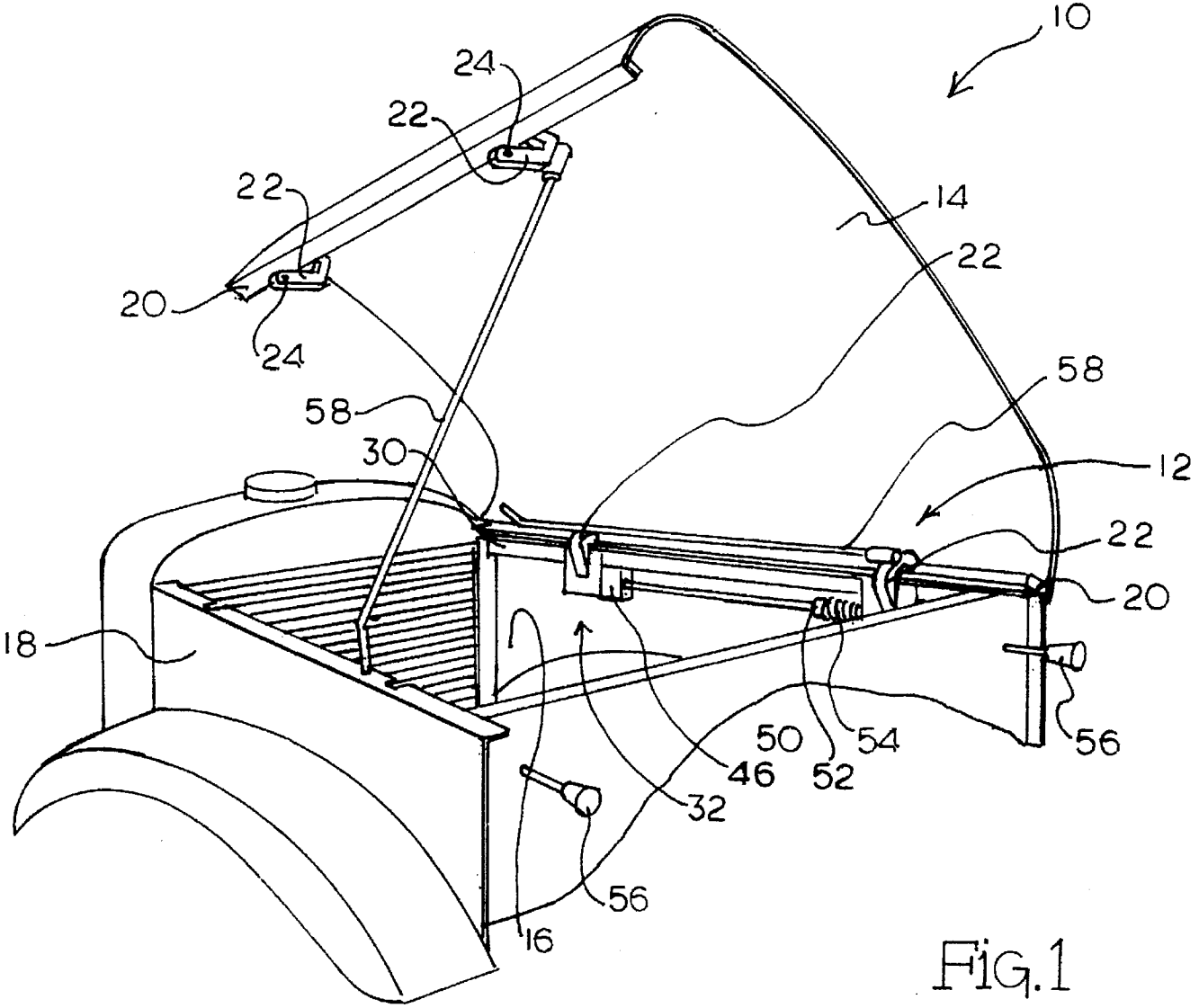
FIG. 1 is a fragmentary perspective view of a raised hood disposed over an open engine compartment with the hood being connected by the double-hinge kit of the present invention.

With further reference to the drawings, the double-hinge kit of the present invention is shown therein and indicated generally by the numeral 10. The double-hinge kit 10 of the present invention is designed to connect a vehicle hood 14 securely about a hood opening 16. The hood opening is meant to mean the top opening of the engine compartment of a vehicle and is defined by a frame structure that extends around the hood opening or engine compartment opening 16 and the surrounding frame structure is identified by the numeral 18.

Double-hinge kit 10 includes a pair of separable hinge assemblies, each hinge assembly being generally indicated by the numeral 12. As will be appreciated more fully from subsequent portions of this disclosure, each hinge assembly 12 is adapted and designed to connect one side of the hood 14 to a side portion of the frame structure 18 that extends around the hood opening 16. Because each hinge assembly 16 is separable, this means that the formed hinge joint can be broken or released such that the hood can be opened and closed from the same side that it is hinged. This, of course, means that the hood 14 can be opened and closed from both sides and at the same time, the hood remains connected to the frame structure 18 by a hinge assembly on the side opposite from the side being opened and closed.

Turning now to a discussion of the structure and operation of each hinge assembly 12, it is seen that the hinge assembly 12 includes a first sub-assembly that is designed to connect to a respective side of the hood 14. In this regard, this first sub-assembly includes an elongated hood connector bar 20 that connects directly to an underside of the hood 14. Depending from the hood connector bar 20 is a series of spaced apart hinge arms 22. Each hinge arm 22 includes opposed end portions **22*a* and 22*b*. End portion 22*a* is that portion of the hinge arm that connects to the hood connector bar 20. End portion 22*b* is that portion of the hinge arm 22 spaced from the connector bar 20. Also, end portion 22*b* includes a hinge pin opening 24** that extends through the same.

Each hinge assembly 12 includes a second sub-assembly that is connected to the frame structure 18 surrounding the hood opening 16. As will be understood from subsequent portions of this disclosure, the second sub-assembly is designed to mate with and connect with the first sub-assembly discussed above and comprised of the hood connector bar 20 and the hinge arms 22. As will be apparent, the first and second sub-assemblies may be connected together to form a hinged joint and also the formed hinged joint may be broken or disconnected such that the respective sub-assemblies can be separated for purposes of opening the hood 14.

Now turning to the second sub-assembly, it is seen that the same includes a connector bar or support 30 that is secured to the frame structure 18 surrounding the hood opening 16. Formed on one side of the connector bar 30 is a series of spaced apart side cut-outs. Secured in each side cut-out is a hinge arm seat indicated generally by the numeral 32. As will be appreciated from subsequent portions of this disclosure, the respective hinge arm seats 32 function to receive the respective hinge arms 22 and to stop or station the hinge arms at a certain position such that a hinge pin can be inserted into the hinge pin opening 24 of the respective arms 22. As seen in the drawing, each hinge arm seat is of a generally u-shaped yoke construction and includes a pair of spaced apart legs 34 and 36 connected by a lower base 38. Defined over the lower base 38 and between the legs 34 and 36 is a seat 40. The legs 34 and 36 include a transverse pin opening 42. The base 38 includes an elongated carrier rod opening 44 that extends completely through the same.

Disposed adjacent each hinge arm seat 32 is a movable pin carrier block 46. Pin carrier block 46 includes an elongated hinge pin 48 that projects into and is retained in a pin opening 42 in one of the legs 34 or 36 of the u-shaped hinged arm seat 32. In addition, a carrier pin rod 50 is connected to the pin carrier block 46 and extends through the carrier rod opening 44 of the adjacent hinge arm seat 32. As seen in the drawings, the respective carrier block 46 can be moved back and forth relative to an adjacent hinge arm seat 32. In a preferred design, the carrier block 46 are biased to assume what is referred to as a closed position adjacent a respective hinge arm seat 32. In order to bias the carrier block 46, there is provided a stop 52 on the carrier pin rod 50 and a spring 54 is interposed between one side of an adjacent hinge arm seat 32 and the stop 52. Thus, the action of the spring 54 biases the carrier block 46 towards a closed position.

Figure 2:
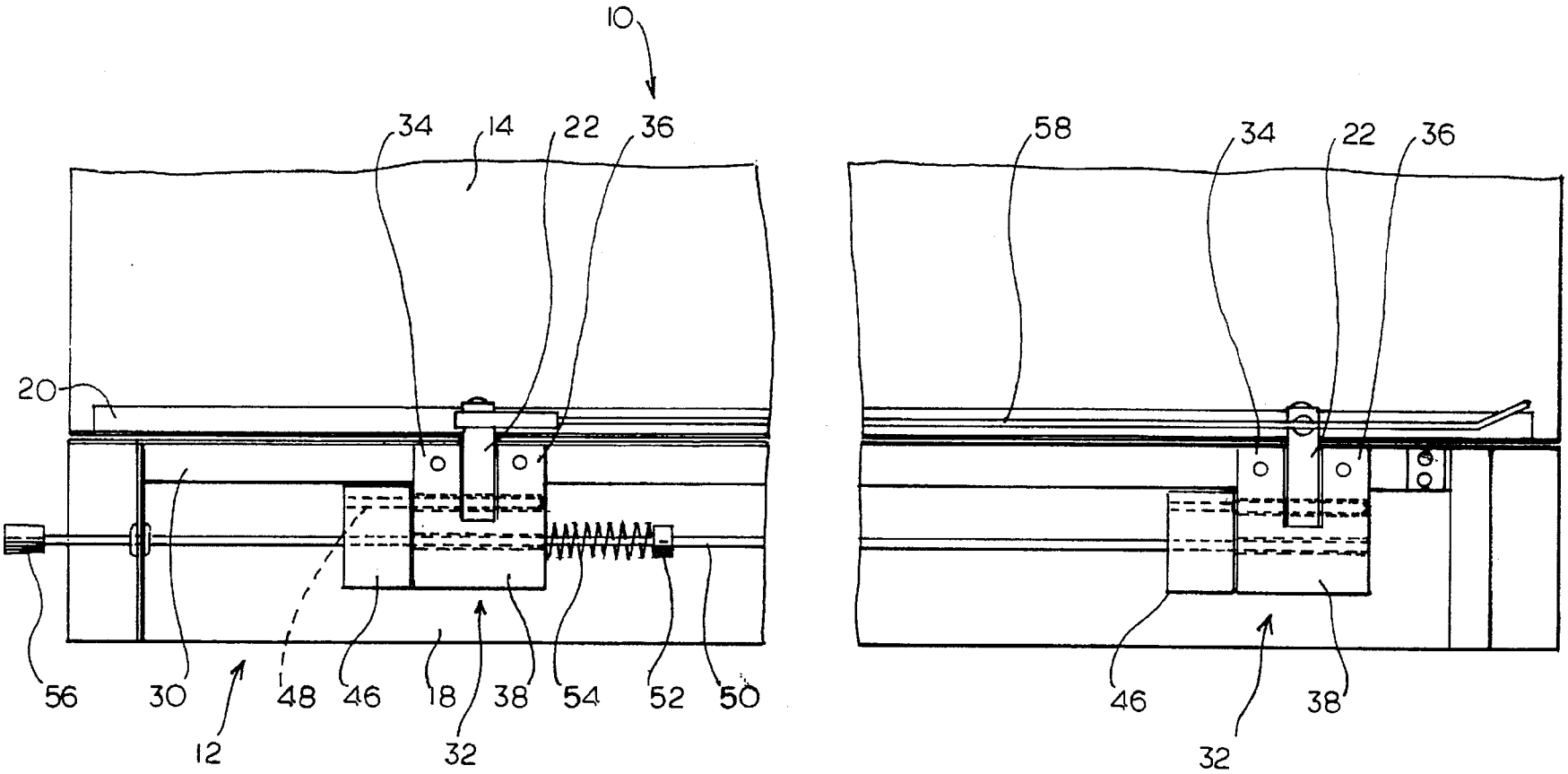
FIG. 2 is a side elevational view of the hinge assembly of the present invention shown in a connected or hinged mode.
Figure 3:
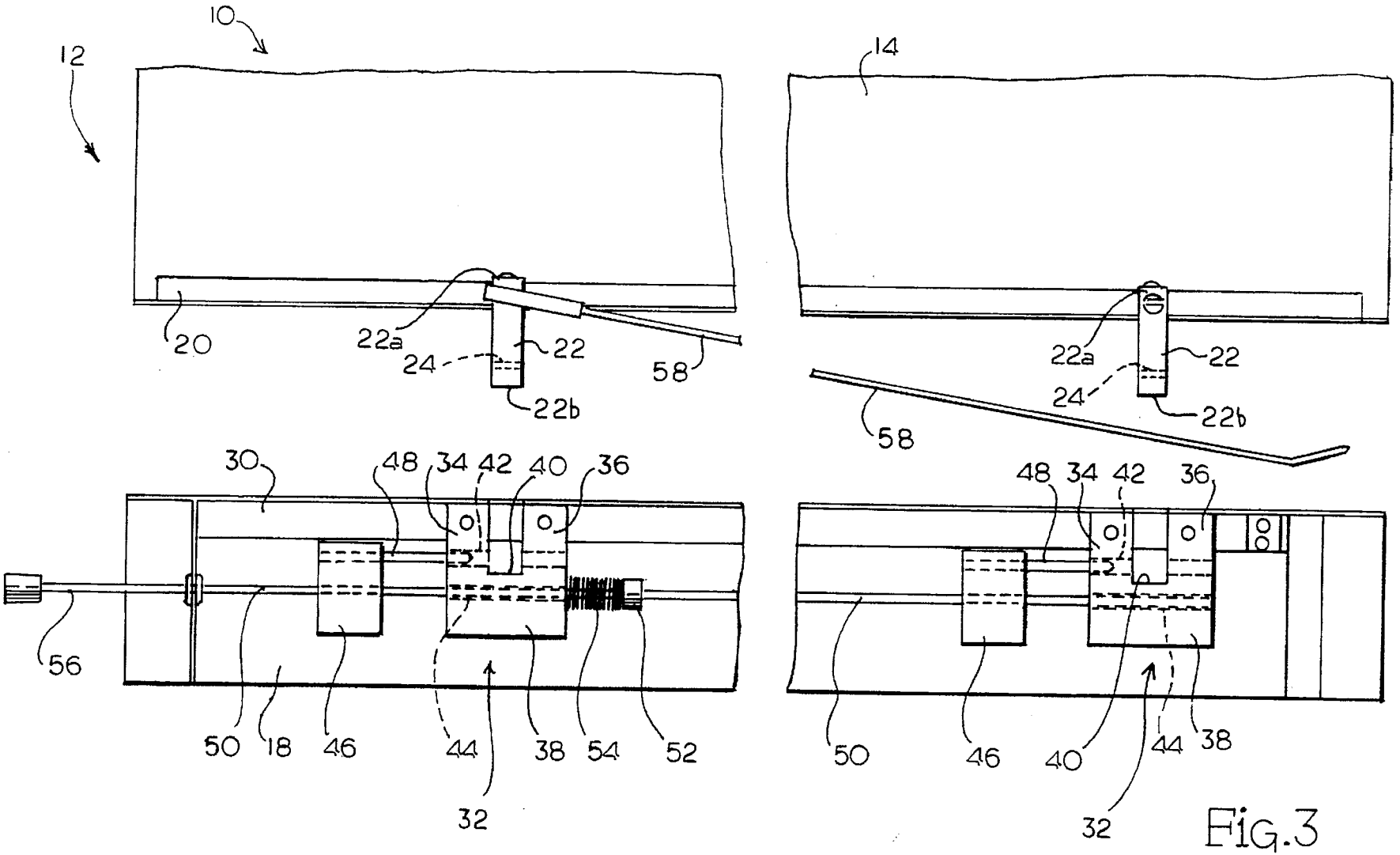
FIG. 3 shows the same hinge assembly of FIG. 2 in a disconnected or non-hinged mode.

As seen in the drawings, in the design illustrated there is provided a pair of carrier blocks 46 that are effectively coupled together by the carrier pin rod 50. In the closed position, illustrated in FIG. 2, the hinge pins 48 carried by the carrier block 46 extend between the respective legs 34 and 36 and through the pin openings 42 formed therein. This is the position assumed by the hinge pins 48 when an actual hinge joint is formed. In this position, the respective hinge pins 48 project through the pin openings 24 formed in the hinge arms 22. In this position, the respective hinge arms 22 rotate about the axis of the respective hinge pins 48.

In order to release the formed hinge joint, there is provided a handle 56 which is effective to retract the carrier pin 50 which results in the carrier blocks 46 being moved away from the hinge arm seats 32. This obviously retracts the respective hinge pins 48 from the gap or space between legs 34 and 36 and, at the same time, retracts the respective hinge pins 48 from the hinge pin openings 24 formed in the hinge arms 22. Once this has been accomplished, it follows that the respective hinge arms 22 are freed and this enables the entire side of the hood 14 to be opened and closed.

It is appreciated that the same hinge assembly 12 is mounted on each side of the hood and is connected to the adjacent frame structure 18 underlying the hood. Thus, it is appreciated that the hood 14 would be connected to the frame structure 18 surrounding the hood opening 16 by two like hinge assemblies 12. This would, of course, mean that at any time, at least one hinge assembly 12 would assume a connected or hinged mode. This would allow the opposite side to assume a release or disconnected mode such that that side of the hood 14 could be raised and lowered.

Figure 4:
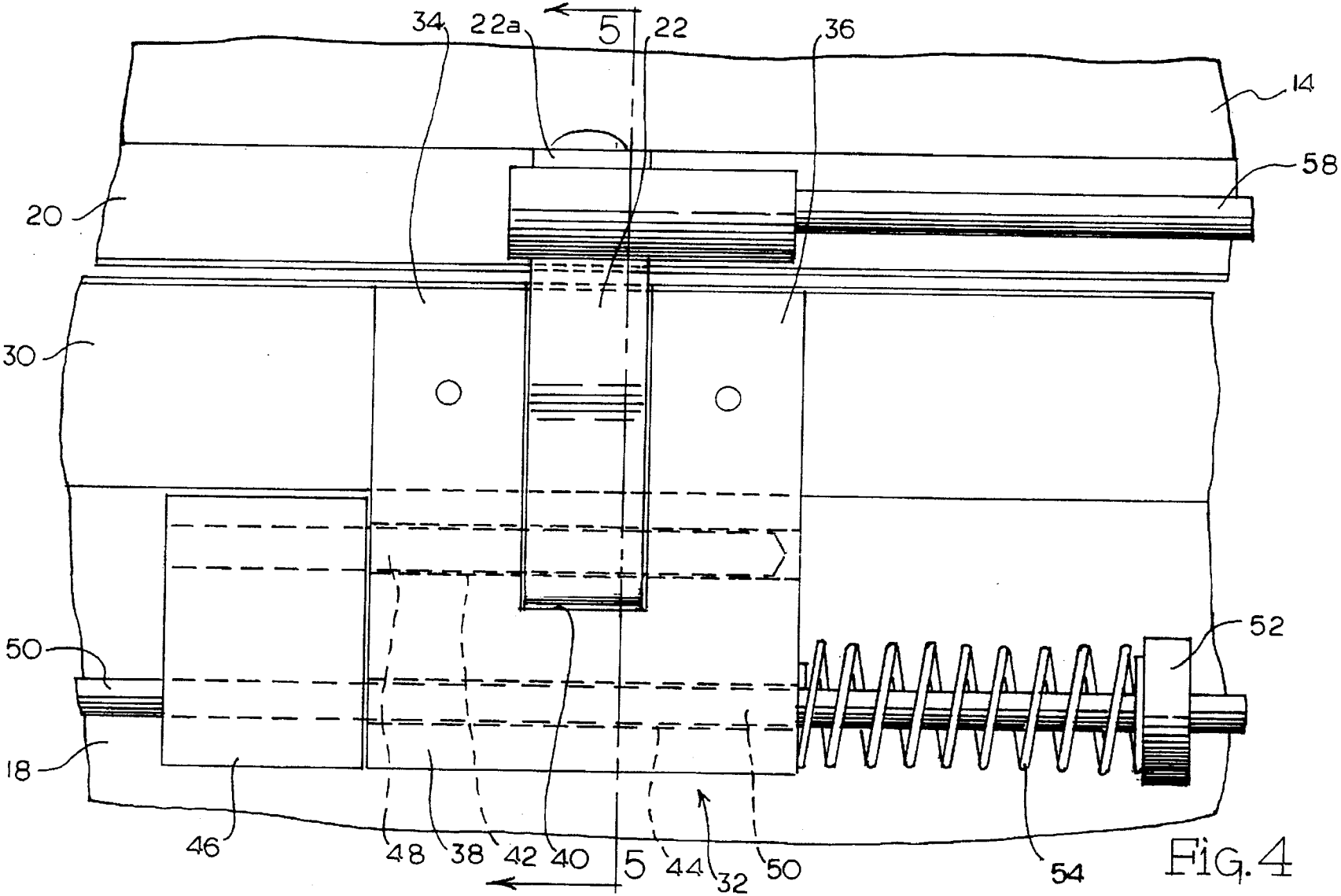
FIG. 4 is an enlarged side elevational view of a portion of the hinge arm assembly, particularly showing a respective hinge arm connection.
Figure 5:
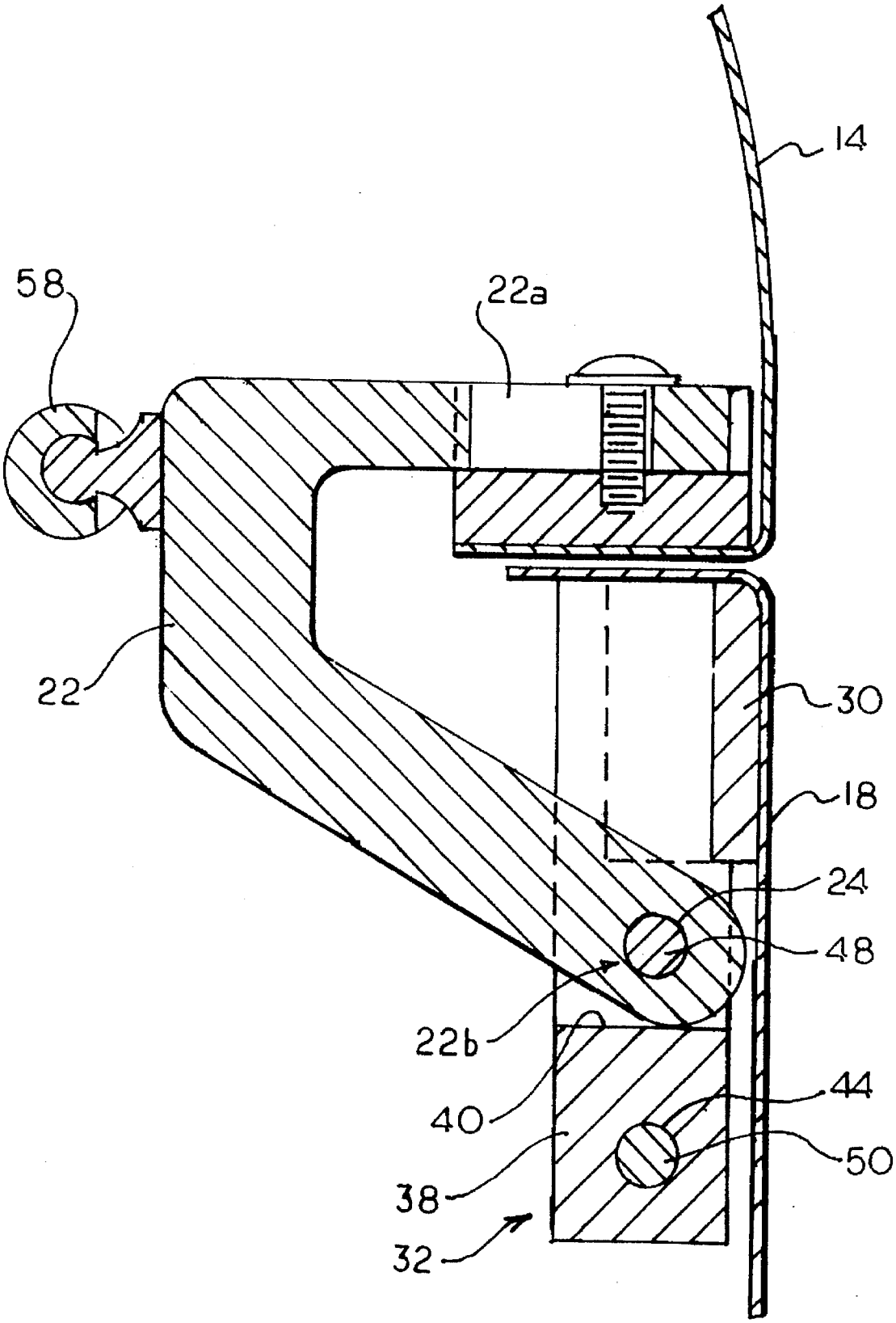
FIG. 5 is a sectional view taken through the lines 5—5 of FIG. 4.

After the hinge arms 22 have been released by the hinge pins 48 and the arms 22 have been raised upward from the hinge arm seats 32, the operator will release the handle 56 and because of the spring 54, the carrier block 46 and associated hinge pins 48 will be moved to the extended or closed position shown in FIG. 4. Thus, when the hinge arms 22 are lowered back into the hinge arm seats 32, the lower ends 22b of the arms 22 will first engage the top of the respective hinge pins 48 unless they have been previously retracted. By pulling the handle 56, the hinge pins 48 can be retracted and the hinge arms 22 can be further lowered to where the lower end **22*b* engages the formed seat 40 that is formed between the legs 34 and 36. Once this occurs, the respective pin openings 24 in the arms 22 are correctly aligned with the hinge pins 48 carried by the pin carrier block 46. Now the handle 56 can be released and the hinge pins 48 will be projected into the respective pin openings 24 of the arms 22**. This effectively forms a closed hinge joint assembly.

Finally, each hinge assembly 12 includes a hood prop 58 that is normally mounted at one end to a particular hinge arm 22. The other end of the prop is releasably held. Thus, the hood prop 58 can be positioned to support the hood in a raised position.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended Claims are intended to be embraced therein.

What is claimed:

1. A double-hinge kit for a vehicle hood that allows the hood to both hinge and open from opposite sides comprising: a pair of side-hinge assemblies with each hinge assembly connected to one side of the vehicle hood and to an adjacent frame structure of the vehicle that extends around a hood opening; each hinge assembly including a hood connector securable to the hood; a plurality of spaced-apart hinge arms secured to the hood connector and extending therefrom with each hinge arm having a hinge pin opening formed therein; a plurality of retractable and extendible hinge pins adapted to be mounted on the adjacent frame structure of the vehicle, the hinge pins being movable between retracted and extended positions an actuator operative to move the hinge pins back and forth between the retracted and extended positions; at least one stop mountable on the adjacent frame structure of the vehicle and aligned so as to stop and generally fix the position of the hinge arms in a lower hinged position such that the retractable hinge pins align with the pin openings in the hinge arms such that the hinge pins can be extended into the pin openings of the hinge arms or retracted therefrom allowing the vehicle hood to hinge about the hinge pins or to open about the same side by retracting the hinge pins from the pin openings of the hinge arms and wherein the stop includes a seat for receiving and supporting a respective hinge arm and structure extending from the seat that includes a pin alignment opening therein, and wherein the pin alignment opening is spaced so as to align with the pin opening in a respective hinge arm when the hinge arm engages the seat of the stop.

2. The double-hinge kit of claim 1 wherein the plurality of hinge pins of each hinge assembly are mounted to a carrier rod that is connected to the actuator and wherein the carrier rod is movable back and forth which causes the respective hinge pins to be moved between the extended and retracted positions.

3. The double-hinge kit of claim 2 wherein there is provided a hood prop connected to the hood connector.

4. The double-hinge kit of claim 3 including a spring for biasing the hinge pins toward an extended position where the hinge pins extend through respective pin openings of the hinge arms.

5. The double-hinge kit of claim 1 wherein the stop is of a generally U-shape and wherein the pin alignment opening is formed in at least one side of the generally U-shaped stop.

6. A double-hinge kit for a vehicle hood that enables both sides of the hood to be hinged about a hood opening and also permits both sides of the hood to be opened and closed, the double-hinge kit comprising:

a) a pair of side hinge assemblies with each side hinge assembly operative to connect one side of the hood to a respective side of the hood opening and each side hinge assembly being further operative to release and permit the hood to be opened and closed about the same side;

b) each side hinge assembly including at least one hinge arm having a pin opening formed therein, the hinge arm being mountable to one side of the vehicle hood and movable with the hood between an open position and a closed position;

c) a stop adapted to be mounted adjacent the hood opening for stopping the hinge arm and generally receiving and holding the hinge arm in the closed position, the stop including a pin alignment opening formed therein;

d) an extendible and retractable hinge pin movable between a retracted disengaged position and an extended hinged position where the hinge pin extends through the pin alignment opening for the stop and the pin opening in the hinge arm;

e) an actuator for moving the hinge pin back and forth between the retracted disengaged position and the extended hinged position;

f) wherein the stop assumes a position so as to limit the downward movement of the hinge arm when the hinge arm assumes the closed position such that the hinge pin aligns with the pin opening therein and can be inserted through the pin opening of the hinge arm; and g) wherein the double-hinge kit of the present invention enables a vehicle hood to be hinged about opposite sides about the hood opening of a vehicle but also allows each hinge assembly to be selectively disconnected such that the hood may be opened about each side while the same hood is hingeably connected to the vehicle about the other opposite side.

7. A kit for connecting a vehicle hood to a hood opening that enables both sides of the hood to be either hinged or opened about the hood opening, the kit comprising a pair of side hinge assemblies with each side hinge assembly being adapted to either connect one side of the hood to a respective side of the hood opening or to permit the side of the hood to raise and open, each side hinge assembly comprising:

a) a first elongated hood connector bar adapted to be connected to one side of the vehicle hood;

b) a pair of spaced apart hinge arms connected to the first hood connector bar and extending therefrom, each hinge arm including a terminal end portion having a pin opening formed therein;

c) a second elongated connector bar adapted to be connected adjacent the hood opening;

d) a pair of laterally spaced hinge arm seats secured to the second connector bar, each hinge arm seat including a lower portion, a pair of spaced apart legs, and a seat area for receiving and supporting a respective hinge arm when the hinge arm has been lowered into the hinge arm seat;

e) a pin alignment opening formed in at least one of the legs of each hinge arm seat;

f) a carrier pin opening formed in the lower portion of each hinge arm seat;

g) a pair of carrier blocks disposed adjacent each of the hinge arm seats and movable back and forth relative to the hinge arm seats;

h) a carrier pin connected between the carrier blocks and extending through the lower carrier pin openings formed in the hinge arm seats;

i) a hinge pin secured to each of the carrier blocks and projecting therefrom, each hinge pin being generally aligned with the pin opening formed in at least one leg of an adjacent hinge arm seat, and wherein in a connected and hinged position the hinge pins project from the carrier blocks through hinge pin openings formed in respective legs of the hinge arm seats and through the pin openings formed in the terminal ends of the hinge arms; and j) an actuator operative to move the two hinge pins back and forth between connected and released positions wherein in the connected position each hinge pin forms a hinged connection with a respective hinge arm and in the released position the hinge pins are retracted from the same hinge arms.

8. The kit of claim 7 wherein the actuator includes a rod operatively connected to each side hinge assembly for moving the respective hinge pins back and forth.

9. The kit of claim 7 wherein each hinge arm assumes a generally U-shape.

10. The double-hinge kit of claim 7 wherein the respective hinge arm seats are generally u-shaped and include an open top for allowing the respective hinge arms to move through the hinge arm seats.

11. The double-hinge kit of claim 10 wherein each generally u-shaped hinge arm seat receives and confines both the carrier pin and a respective hinge pin and wherein the carrier pin and the hinge pin can move back and forth within the u-shaped hinge arm seat.

12. The double-hinge kit of claim 11 wherein the respective hinge pins are spring biased to assume a closed extended position within the respective hinge arm seats.

* * * * *